US006415450B1

(12) United States Patent
Lien

(10) Patent No.: US 6,415,450 B1
(45) Date of Patent: Jul. 9, 2002

(54) MAN'S UNDERPANTS WITH TRANSVERSE URINATION OPENING

(75) Inventor: Lan-Tai Lien, Sanchung (TW)

(73) Assignee: Windchimes House Co., Ltd., Taipei (TW)

( * ) Notice: Subject to any disclaimer, the term of this patent is extended or adjusted under 35 U.S.C. 154(b) by 0 days.

(21) Appl. No.: 09/809,403

(22) Filed: Mar. 14, 2001

(30) Foreign Application Priority Data

Oct. 6, 2000 (TW) ..... 89217410 U

(51) Int. Cl.[7] ..... A41B 9/02
(52) U.S. Cl. ..... 2/400; 2/403; 2/405
(58) Field of Search ..... 2/400, 403, 227, 2/228, 238, 405

(56) References Cited

U.S. PATENT DOCUMENTS

| | | | | | |
|---|---|---|---|---|---|
| 2,138,481 | A | * | 11/1938 | Chatfield | 2/403 |
| 2,638,900 | A | * | 5/1953 | Gruenberg et al. | 2/403 |
| 3,322,120 | A | * | 5/1967 | Wyss et al. | 2/403 |
| 3,459,181 | A | * | 8/1969 | Mann | 2/403 |
| 3,487,833 | A | * | 1/1970 | Senser | 2/403 |
| 4,195,630 | A | * | 4/1980 | Connery | 2/403 |
| 5,210,879 | A | * | 5/1993 | Miller | 2/400 |
| 5,290,270 | A | * | 3/1994 | Fisher | 2/403 |
| 5,555,568 | A | * | 9/1996 | Yon | 2/403 |
| 6,047,408 | A | * | 4/2000 | Brill, Jr. | 2/403 |

* cited by examiner

*Primary Examiner*—Gloria M. Hale

(57) ABSTRACT

An underpants for man are characterized by a transverse urination opening provided thereon for making a man convenient to urinate.

14 Claims, 5 Drawing Sheets

MAN'S UNDERPANTS WITH TRANSVERSE URINATION OPENING

FIELD OF THE INVENTION

The present invention is directly relative to a man's underpants with a transverse urination opening.

BACKGROUND OF THE INVENTION

Typically, an urination opening is necessary to be created on current man's underpants to make a man convenient to urinate. However, the urination opening provided on a modern underpants for man is commonly designed to be a straight opening. FIG. 1 shows a cotton underpants for man provided with a straight urination opening for facilitating a man's urination. Nevertheless, when a man dressed in an underpants of FIG. 1 desires to urinate, the outer sheathing cloth 12 must be pulled left by hand and then the inner sheathing cloth 13 also must be pulled right by hand. The operation to the sheathing cloth of the underpants for man is not very convenient and tasteful, and thus the conventional underpants is not quite suitable for a modern man.

Referring to FIG. 2, the woven underpants 20 also include a straight urination opening 21 and a button 22 provided thereon. When a man intends to urinate and the underpants are unbuttoned, the outer sheathing cloth 23 also must be pulled left by hand and then the inner sheathing cloth 24 also must be pulled right by hand. As a result, it is somewhat unqualified to become an ideal underpants for man.

Therefore, the applicant contributes heaps of efforts in developing an ideal underpants for man, and presents a novel underpants for man, in which a transverse urination opening is provided thereon that can make man's urination process more convenient and tasteful.

SUMMARY OF THE INVENTION

An object of the present invention is to provide an underpants for man which can make a man convenient to urinate.

Another object of the present invention is to provide an underpants for man with a tasteful contour.

To this end, the underpants for man according to the present invention are characterized by a transverse urination opening provided thereon for making a man convenient to urinate.

Preferably, the urination opening is located at the middlemost region of man's underpants. Alternatively, the urination opening is located above or below the middlemost region of man's underpants.

Additionally, the underpants for man according to the present invention further include a lining located below the transverse urination opening, and an extending list located either in the interior or exterior of the underpants for shielding the transverse urination opening. Moreover, the underpants for man according to the present invention further include a reinforced list twined around the transverse urination opening.

The underpants for man according to the present invention may be twined by cotton or woven fabric. On the other hand, the transverse urination opening can be linear or archwise.

In addition, the underpants for man according to the present invention further include a button for buttoning the transverse urination opening.

Now the foregoing and other features and advantages of the present invention will be more clearly understood through the following descriptions with reference to the accompanying drawings, in which:

DETAILED DESCRIPTION OF THE PREFERRED EMBODIMENT

Figure 1:
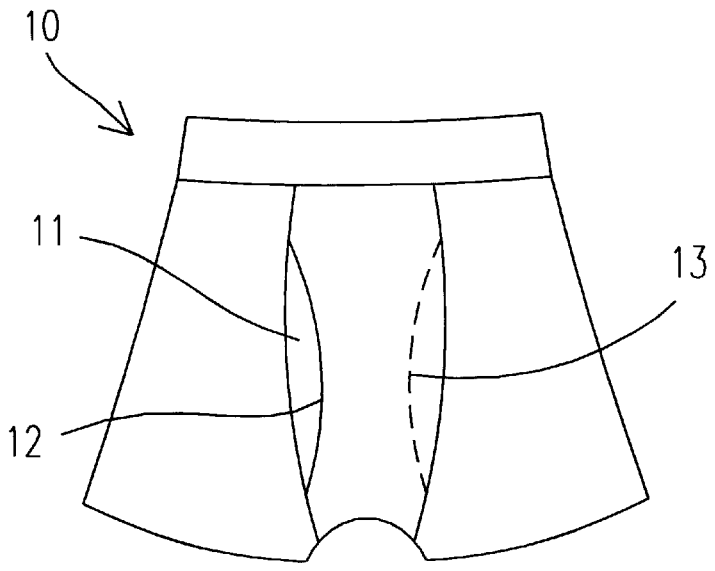
Fig. 1(PRIOR ART)
FIG. 1 shows a cotton underpants for man provided with a straight urination opening according to the prior art.
Figure 2:
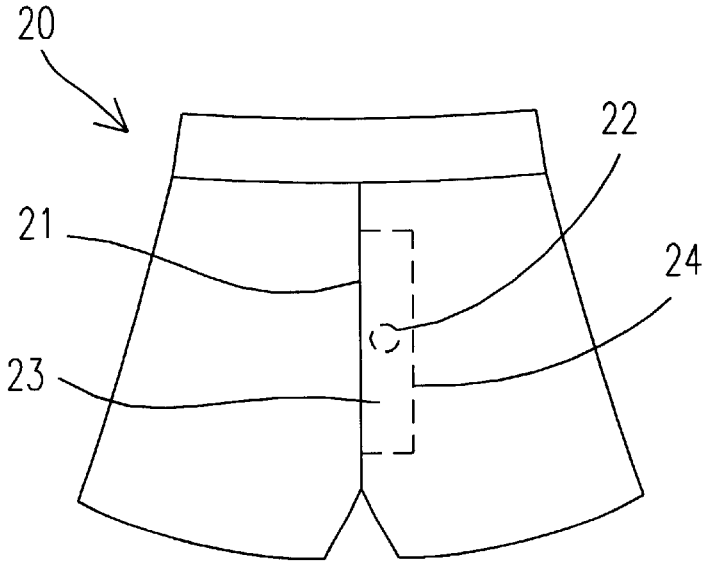
Fig. 2(PRIOR ART)
FIG. 2 shows a woven underpants provided with a straight urination opening and a button according to the prior art.
Figure 3:
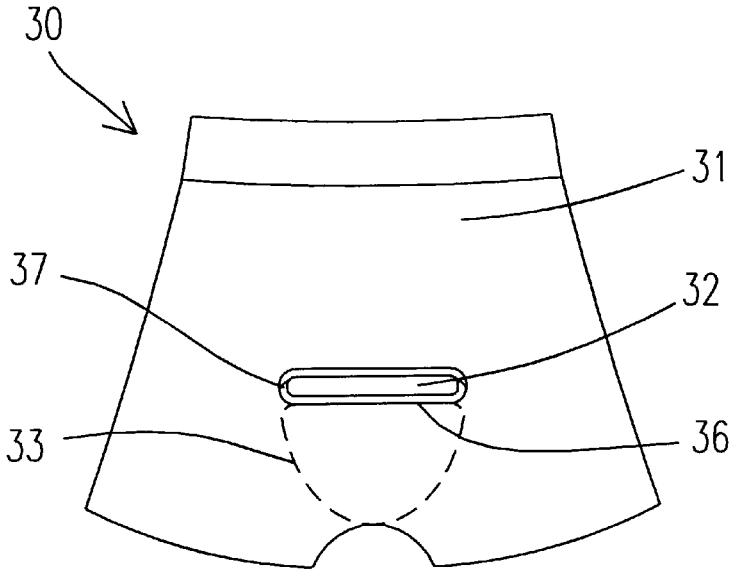
FIG. 3 shows an exemplary underpants provided with a transverse urination opening according to a first preferred embodiment of the present invention.

Referring now to FIG. 3, the underpants 30 for man according to the present invention are provided with a transverse urination opening 32 for making a man convenient to urinate. Unlike the prior art underpants for man, the design of the urination opening provided with man's underpants according to the present invention is modified to be transverse. Therefore, when a man is in an urgent need to urinate, the underpants of the present invention will be more convenient and comfortable for a man to dress in.

Figure 4:
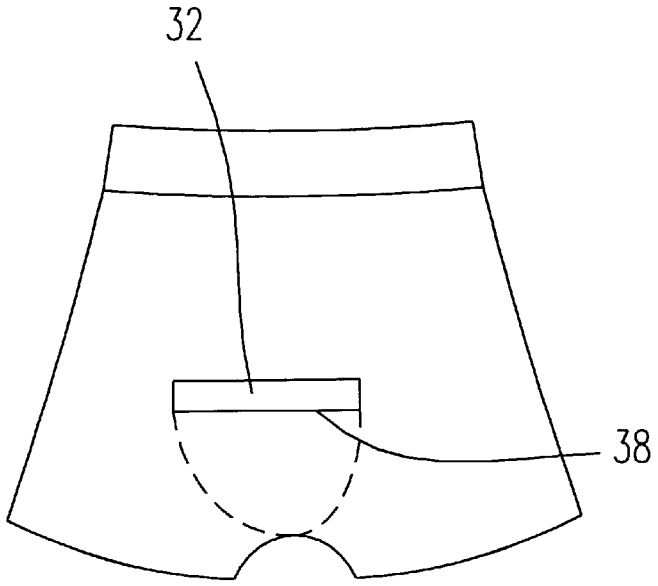
FIG. 4 shows a second preferred embodiment of the underpants according to the present invention.

The transverse urination opening 32 can be located at the middlemost region of the underpants 30, or else the urination opening 32 can be located above or below the middlemost region of the underpants 30. As shown in FIG. 4, the transverse urination opening 32 is located on the left-biased region of the underpants, which is in favor of a left-hander to urinate when dressed in the underpants of the present invention. The underpants according to the present invention further include a lining 38 located below the transverse urination opening 32. The underpants of the present invention can be twined by cotton.

Figure 5:
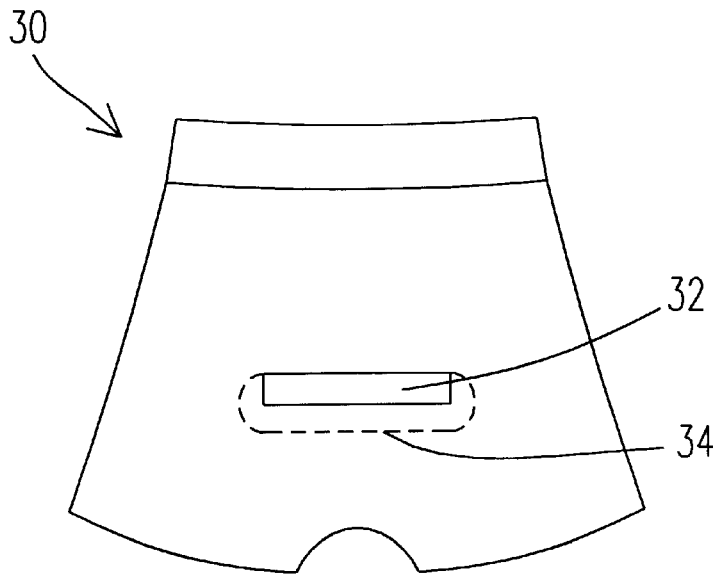
FIG. 5 shows a third preferred embodiment of the underpants according to the present invention.
Figure 6:
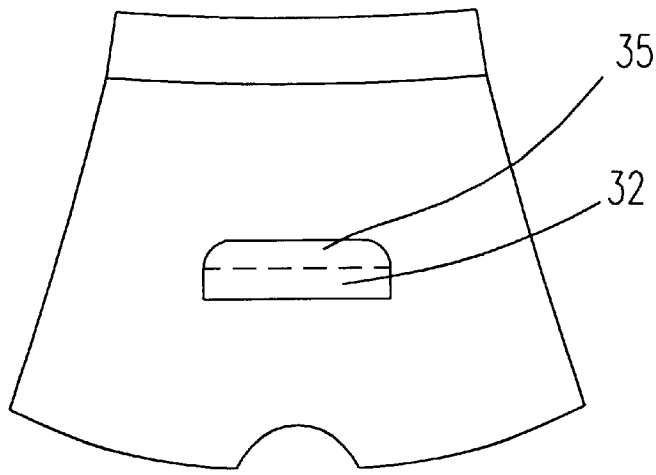
FIG. 6 shows a fourth preferred embodiment of the underpants according to the present invention.

In FIG. 5, an extending list 34 is further provided with the underpants of the present invention. The extending list 34 is either located in the interior of the underpants or located in the exterior of the underpants as shown in FIG. 6. The extending list 34 is used to shield the transverse urination opening 32 of the underpants 30 according to the present invention.

Figure 9:
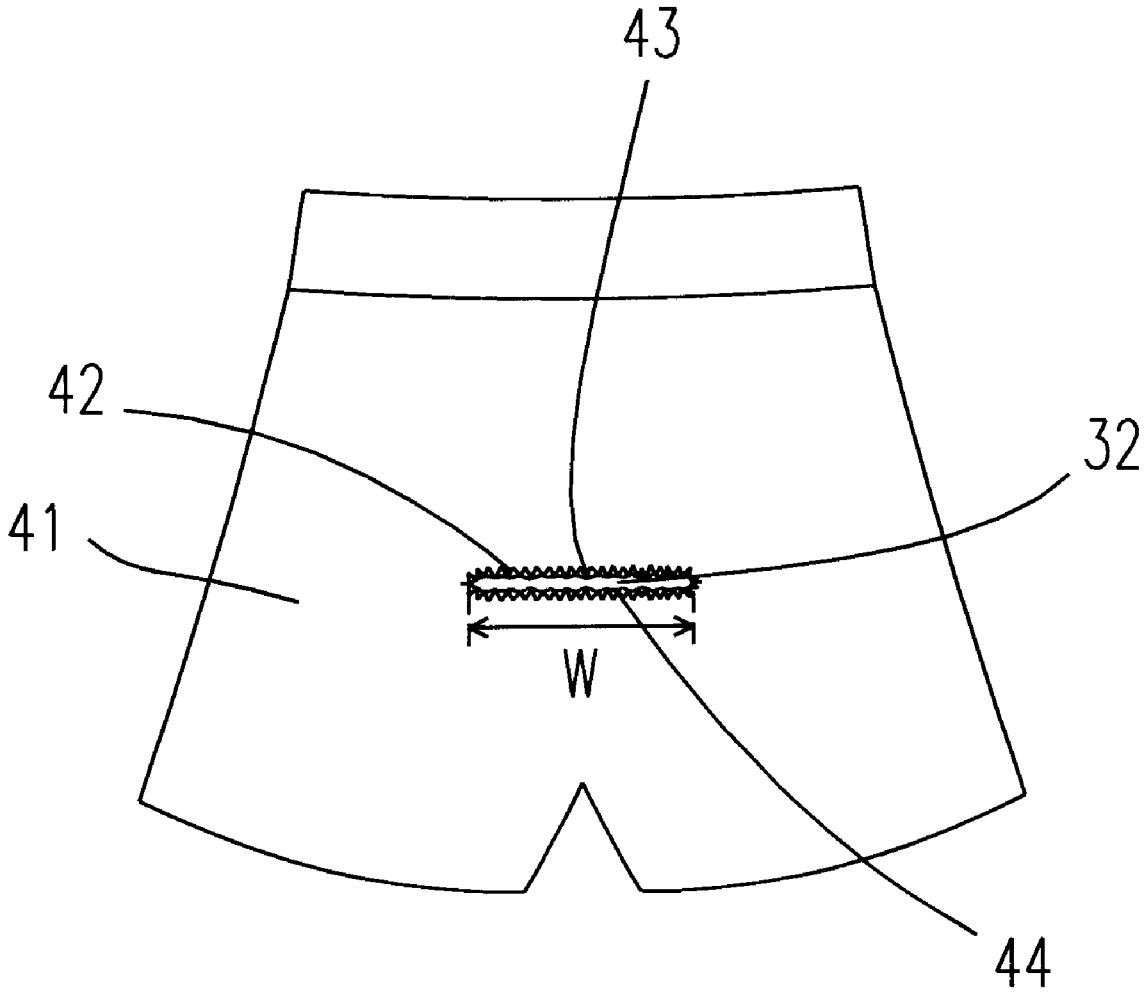
FIG. 9 shows a seventh preferred embodiment of the underpants according to the present invention.

Referring to FIG. 3 again, a thin list 36 is applied to be twined into a reinforced list 37 around the transverse urination opening 32 for extending the longevity of the underpants 30. In FIG. 9, the transverse urination opening 32 is created by cutting away the front cloth of the underpants 30, and then twine the yarn 42 into an upper hem 43 and a lower hem 33.

Figure 7:
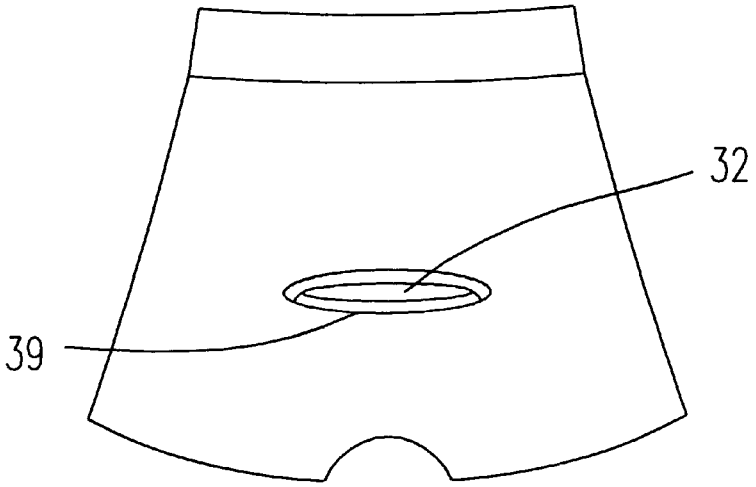
FIG. 7 shows a fifth preferred embodiment of the underpants according to the present invention.
Figure 8:
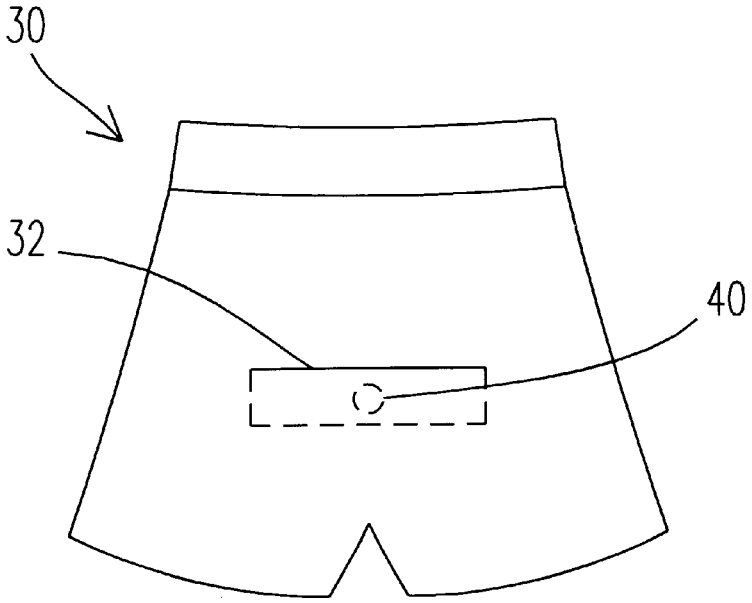
FIG. 8 shows a sixth preferred embodiment of the underpants according to the present invention.

References are now made to FIG. 4, FIG. 7 and FIG. 8. The transverse urination opening 32 can be a linear opening 38 as shown in FIG. 4, or can be an archwise opening 39 as shown in FIG. 7. In FIG. 8, the underpants of the present invention can be twined by woven fabric, and includes a button 40 for buttoning the transverse urination opening 32.

In summary, it can be clearly understood that the present invention contrives a novel man's underpants with a transverse urination opening which is favorable for a man to urinate. In this way, man do not need to spend too much efforts in the urination process as previously described.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not taken as limiting the scope of the present invention which is defined by the appended claims.

I claim:

1. An underpants for man, characterized in that a transverse urination opening is provided thereon for facilitating a man's urination, wherein said underpants further comprises a lining located below said transverse urination opening.

2. The underpants according to claim 1 wherein said transverse urination opening is located at the middlemost region of said underpants.

3. The underpants according to claim 1 wherein said transverse urination opening is located above the vertically middlemost region of said underpants.

4. The underpants according to claim 1 wherein said transverse urination opening is located below the vertically middlemost region of said underpants.

5. The underpants according to claim 1 further comprising an extending list being an extension attached to said transverse urination opening and located in the interior of said underpants for shielding said transverse urination opening.

6. The underpants according to claim 1 further comprising an extending list being an extension attached to said transverse urination opening and located in the exterior of said underpants for shielding said transverse urination opening.

7. The underpants according to claim 1 further comprising a reinforced list being a lip twined around said transverse urination opening.

8. The underpants according to claim 1 wherein said transverse urination opening is linear.

9. The underpants according to claim 1 wherein said transverse urination opening is archwise.

10. The underpants according to claim 1 wherein said underpants including said transverse urination opening are twined by cotton.

11. The underpants according to claim 1 wherein said underpants including said transverse urination opening are twined by a woven fabric.

12. The underpants according to claim 1 further comprising a button for buttoning said transverse urination opening.

13. An underpants for man, characterized in that a transverse urination opening is provided thereon for facilitating a man's urination, wherein said underpants including said transverse urination opening are twined by cotton.

14. An underpants for man, characterized in that a transverse urination opening is provided thereon for facilitating a man's urination, wherein said underpants including said transverse urination opening are twined by a woven fabric.

* * * * *